US005285543A

United States Patent [19]

Rowe

[11] Patent Number: 5,285,543

[45] Date of Patent: Feb. 15, 1994

[54] COMBINATION TOOL DEVICE

[76] Inventor: Robert G. Rowe, 382 Spanish Oak, Bullard, Tex. 75757

[21] Appl. No.: 25,875

[22] Filed: Mar. 3, 1993

[51] Int. Cl.[5] ..... B25B 13/00

[52] U.S. Cl. ..... 7/138; 7/165; 81/177.4; 81/490; 81/177.5

[58] Field of Search ..... 7/100, 138, 165, 167; 81/177.4, 437, 125.1, 124.4, 490, 177.5

[56] References Cited

U.S. PATENT DOCUMENTS 3,680,159 8/1972 Wharram ..... 7/138 X 4,960,016 10/1990 Seals ..... 7/138 X 5,086,674 2/1992 Her ..... 7/138 X

*Primary Examiner*—James G. Smith

*Attorney, Agent, or Firm*—Ronald B. Sefrna

[57] ABSTRACT

A combination tool device having a double ended socket wrench, a handle with a screwdriver tip, and a file disposed in the handle is provided. The file may be removed from the handle and used as a separate tool, or may be first removed and then releasably reconnected so that the other components function as a file handle. The file may also be disposed so that it is stored in the handle and may be extended and releasably fixed in extended position for use.

19 Claims, 2 Drawing Sheets

COMBINATION TOOL DEVICE

FIELD OF THE INVENTION

The present invention generally relates to tool devices, and more specifically relates to a combination tool device particularly useful for maintaining chain saws under field conditions.

BACKGROUND OF THE INVENTION

Chain saws used in, for example, logging operations require regular and frequent maintenance to keep the saws in efficient operating condition. Under typical conditions a logger or other chain saw user will travel on foot a considerable distance into the forest from the logger's truck or other base of operations, and the saw user must carry the tools and supplies needed to adjust and maintain the saw. Those tools typically include at least one socket wrench with two different sized sockets, a screwdriver, and a chain file. Keeping up with separate tools and avoiding loss and/or breakage while they are carried can be a problem.

Various types of combination tool devices are known in the prior art for various uses. U.S. Pat. No. 5,067,190 to Gagnon discloses a combination of cutting tools, including a hatchet, a handsaw with an assortment of interchangeable blades, and a utility knife. Though useful for its intended purpose, the Gagnon tool does not provide the tools needed for field maintenance of chain saws and similar motor driven tools.

Another example of a combination tool is found in U.S. Pat. No. 5,001,796 to Desjardins. The Desjardins patent discloses a combination scraper and file tool, with the file stored in a recess in the scraper. Again, the Desjardins tool does not provide a combination of tools useful for the purpose of maintaining gasoline engine driven tools such as chain saws.

Tool devices combining a double-ended socket wrench and a screwdriver are known in the art, but the prior art tools do not include a file or provide a way to protect a file.

There remains a need for a combination tool including the implements particularly needed for the maintenance of chain saws and other gasoline engine driven tools.

SUMMARY OF THE INVENTION

The combination tool of the invention includes a double-ended socket wrench with different socket sizes at each end, and a hollow handle connected at one end to the socket wrench between the two ends of the wrench and extending perpendicular to the wrench. The end of the handle opposite the wrench is beveled to provide a standard screwdriver blade. An aperture is provided through the wrench in alignment with the longitudinal axis of the hollow handle, to provide a passageway into the interior of the handle, and a closure means is provided to close the wrench aperture opening. The interior surface of the hollow handle adjacent to the socket wrench is threaded. The tool of the invention also includes a saw file, with a cross-sectional dimension smaller than the inside dimension of the hollow handle, so that the file can be inserted through the wrench aperture and into the interior of the handle, and the length of the file is approximately equal to the interior length of the handle. One end of the file is enlarged to a dimension slightly larger than the inside dimension of the hollow handle and is threaded to mate with the threads of the handle.

The file may be stored in the handle of the tool with the majority of its length extending through the interior of the hollow handle, with the closure means closed to retain the file in place. When the file is to be used, the closure means closing the wrench aperture is opened and the file is slid from the interior of the hollow handle. The file may then be used as a separate tool, or may be reversed and threaded into the handle. When connected to the handle the file extends from the socket wrench in alignment with, but in the opposite direction from, the handle, so that the socket wrench and its handle function as a handle for the file. Since the file is not permanently connected to the remainder of the tool, the file may be easily replaced when it becomes dull or is damaged.

In an alternative embodiment the handle is adapted to allow access to the hollow interior other than through the wrench aperture. The handle may be divided between its ends and each portion provided with mating threads, or the handle may be threaded into the socket wrench, for example. In this embodiment the inside dimension of the handle is sufficiently large to receive the threaded end of the file, except at the end connected to the socket wrench. The inner surface of the handle adjacent to the wrench is threaded to receive the threaded end of the file. The file is disposed in the interior of the hollow handle with the threaded end of the file at the outer end of the handle. In this alternative embodiment, the file is used by opening the wrench aperture closure, sliding the file through the wrench aperture until the file threads and handle threads engage, and tightening the file in the handle. With the alternative embodiment, the file is not normally removable from the remainder of the tool, eliminating the possibility that the file will be lost in normal use, but may be removed for replacement when needed.

Structure and features of the preferred and alternative embodiments of the combination tool of the invention will be described in more detail with reference to the accompanying drawing figures.

DETAILED DESCRIPTION OF THE PREFERRED AND ALTERNATIVE EMBODIMENTS

Figure 1:
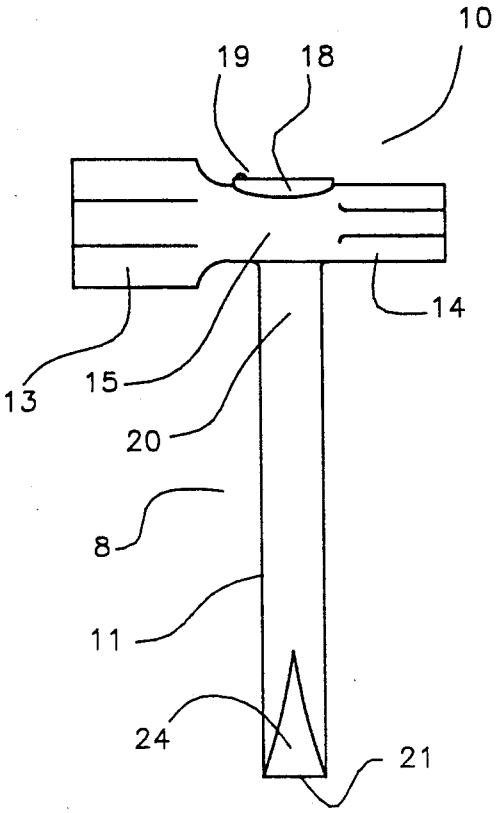
FIG. 1 is a side elevation view of the preferred embodiment of the combination tool of the invention.
Figure 2:
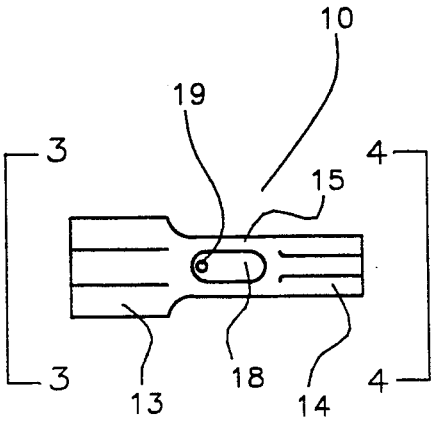
FIG. 2 is a top view of the preferred embodiment of the combination tool of the invention.
Figure 3:
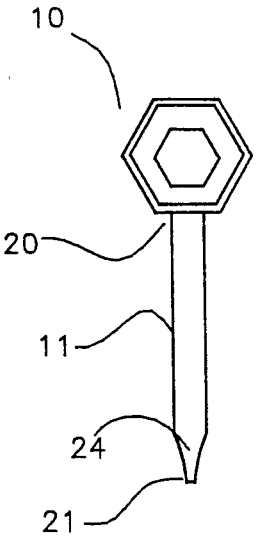
FIG. 3 is an end view of the preferred embodiment of the combination tool of the invention, along line 3—3 of FIG. 2.
Figure 4:
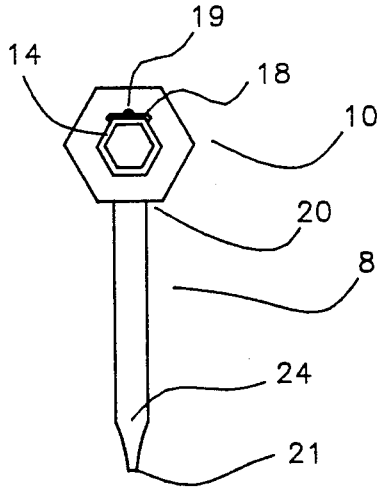
FIG. 4 is an end view of the preferred embodiment of the combination tool of the invention, along line 4—4 of FIG. 2.

With reference to the accompanying drawing figures, the combination tool of the invention, generally designated by reference numeral 8, will be seen to include socket wrench component 10, handle component 11, and file component 12. Socket wrench 10 is an elongate hollow open ended body with a large socket 13 at its first end and a small socket 14 at its second end, and with a middle section 15. Sockets 13 and 14 are of hexagonal cross-sectional configuration and extend from the respective ends of wrench component 10 toward the midpoint of the wrench body a sufficient length to allow each socket to be engaged with a bolt head, nut, or the like. In the preferred embodiment the cross-sectional dimension of middle section 15 is approximately equal to the cross-sectional dimension of small socket 14, though other dimensional relationships may be used, if desired. In the preferred embodiment, large socket 13 is intended to function as a spark plug wrench, with the elongate tip of the spark plug extending into the hollow interior of socket 13, and is appropriately dimensioned for that purpose. Also in the preferred embodiment, small socket 14 is intended to be used on bolts retaining the guide bar of a chain saw, and is appropriately dimensioned for that use. Wrench 10 also includes coaxially aligned apertures 16 and 17 penetrating the wall of middle section 15 with the aligned axes of apertures 16 and 17 intersecting the longitudinal axis of wrench 10. Aperture cover 18 is provided to close aperture 16, and is pivotally interconnected to middle section 15 by pivot pin 19. In the preferred embodiment aperture cover 18 is a plate, but other forms of closure, such as a plug 18 shown in FIG. 7, may be used.

Figure 5:
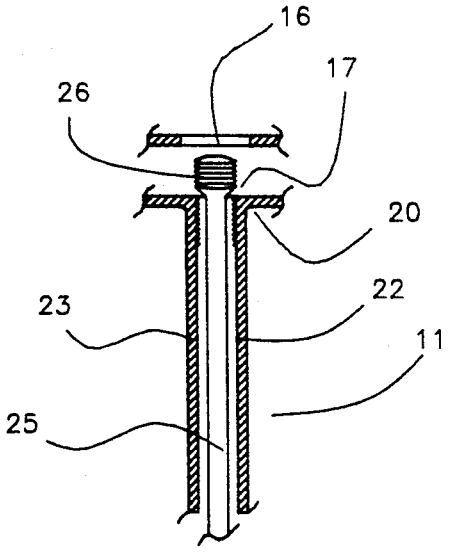
FIG. 5 is a sectioned partial side view of the preferred embodiment of the combination tool of the invention, showing the placement of the file in the handle.

Handle 11 is an elongate shaft with a first end 20 and a second end 21, with a hollow interior 22 extending from first end 20 through the majority of the length of handle 11 and surrounded by wall 23 Handle 11 is interconnected at first end 20 to middle section 15 of wrench 10 in coaxial alignment with apertures 16 and 17. The dimension of aperture 17 is approximately equal to the cross-sectional dimension of interior 22. The second end 21 of handle 11 is beveled to form a screwdriver tip 24. It is preferred that screwdriver tip 24 be in the form of a standard screwdriver, to fit a slotted screw head, but alternative screwdriver configurations may be used. The inner surface of wall 23 adjacent to first end 20 is threaded, as illustrated in FIG. 5.

File 12, intended in the preferred embodiment of tool 8 to be used primarily for sharpening the cutting points on the chain of a chain saw, includes an elongate shaft 25 with an enlarged head 26 at one end thereof. Shaft 25 may be provided in any cross-sectional configuration appropriate for its intended use, and is dimensioned to be received in interior 22 of handle 11. The surface of shaft 25 is formed as a conventional file cutting surface. Head 26 is circular in cross-sectional configuration, is threaded on its outer surface, and is dimensioned to mate with the threaded portion of handle 11. The length of shaft 25 is at least slightly less than the length of hollow interior 22 of handle 11, so that shaft 25 of file 12 will be fully received in interior 22, with head 26 disposed above handle 11 in the interior of central portion 15 of wrench 10.

Figure 6:
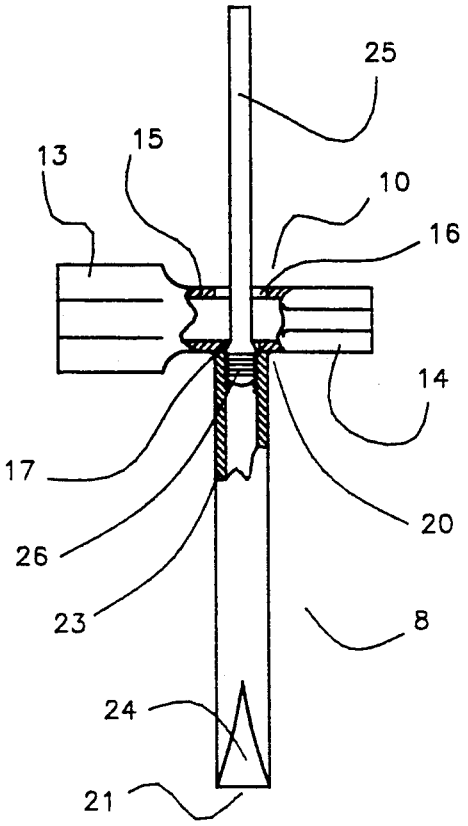
FIG. 6 is a partially sectioned side view of the preferred embodiment of the combination tool of the invention, with the file positioned for use.

File 12 is inserted into handle 11 through apertures 16 and 17, and is retained in the interior of combination tool 8 by aperture cover 18, storing the file so it is readily available and protecting the file from damage or breakage when it is not in use. When file 12 is needed, aperture cover 18 is pivoted away from aperture 16 and file 12 is slid from the interior of the tool. The file may be used as a separate tool, or head 26 may be threaded into handle 11 with shaft 25 extending through apertures 17 and 16 so that wrench 10 and handle 11 of the combination tool function as a file handle, as shown in FIG. 6. With the preferred embodiment of the combination tool, file 12, which is the component of the tool most likely to require replacement, due to dulling or breakage for example, may be easily replaced with a new file component.

Figure 7:
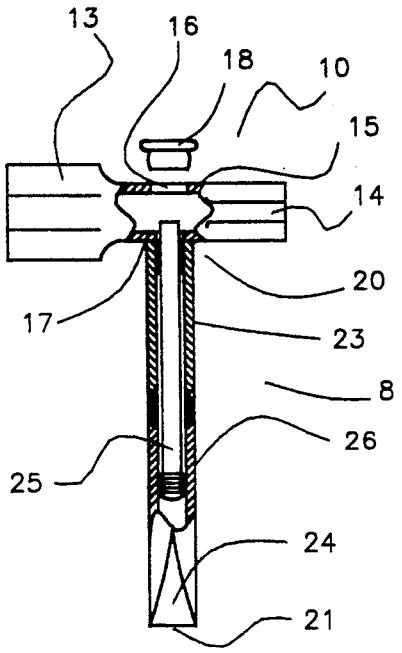
FIG. 7 is a partially sectioned side view of an alternative embodiment of the combination tool of the invention.

In an alternative embodiment of the combination tool of the invention, file 12 is not as readily separable from the other components of the tool. In the alternative embodiment the cross-sectional dimension of hollow interior 22 of handle 11 between the inner end of the treads at first end 20 of the handle and second end 21 is sufficiently large that head 26 of file 12 may freely move longitudinally within the interior of the handle. The cross-section dimension of the threaded portion of the inner surface of wall 23 is not altered from the preferred embodiment, so that head 26 may be threaded into, and through, the threaded portion of wall 23. In the alternative embodiment the orientation of file 12 is reversed within handle 11, as shown in FIG. 7, with head 26 closest to second end 21 of the handle. When file 12 is to be used, aperture cover 18 is removed from aperture 16, shaft 25 of file 12 is slid from the interior of handle 11 through apertures 17 and 16, and head 26 is engaged with the threaded portion of wall 23, supporting the file 12 for use with the remainder of the tool functioning as a file handle in the same manner as in the preferred embodiment. In the alternative embodiment, file 12 may be removed from the handle of the tool by threading head 26 fully through the threads in wall 23, for separate use or replacement of the file, and returned to the handle in the same manner. File 12 may be permanently retained, if desired, by adjusting the size of aperture 17 to allow passage of shaft 25, but not head 26.

In the event it is considered desirable for file 12 to be non-removable from handle 11 during normal use of the combination tool, handle 11 may be laterally divided and provided with mating threads, shown in FIG. 7. In this alternative embodiment file 12 may be replaced by separating handle 11, removing the old file and replacing it with a new file, and reconnecting the parts of handle 11. Although the division of handle 11 is useful for replacing the file, it should be recognized that the use of a threaded connection for the two parts of handle 11 may compromise the usefulness of screwdriver tip 24, since the handle portions may begin to separate if sufficient torque is applied.

The foregoing description of the preferred and alternative embodiments of the combination tool of the invention is illustrative and not for purposes of limitation. The combination tool of the invention is susceptible to other variations and alternative embodiments within the scope of the invention as claimed.

What is claimed is:

1. A combination tool device, comprising a double-ended socket wrench, including an elongate hollow body having an annular wall, open first and second ends, and a longitudinal axis, said annular wall forming a polygonal configuration at and inward of each of said first and second ends, said body including a first aperture penetrating said annular wall between said first and second ends of said body, and said body including a second aperture penetrating said annular wall in coaxial alignment with and in opposed relation to said first aperture across the longitudinal axis of said body;

an elongate handle having a longitudinal axis, an open first end, a closed second end, a hollow interior extending from said open first end through the majority of the length of said handle toward said second end, and an annular wall surrounding said hollow interior, said second end being beveled to form a standard screwdriver blade, and the inner surface of said annular wall being threaded at said first end of said handle, said handle being interconnected at said first end to said body of said socket wrench around said second aperture with the longitudinal axis of said handle in coaxial alignment with said first and second apertures and perpendicular to the longitudinal axis of said body of said socket wrench; and a file, including an elongate shaft with first and second ends and an outer cutting surface, and a head, of larger cross-sectional dimension than said shaft, disposed at said first end of said shaft, said head being threaded on the outer surface thereof and being configured and dimensioned such that said head may be threaded into the threaded first end of said handle, with the length of said shaft being approximately equal to the length of the hollow interior of said handle and the cross-sectional dimension of said shaft being less than the cross-sectional dimension of said hollow interior of said handle, said file removably received in the interior of said socket wrench and said handle with said shaft disposed in the hollow interior of said handle with said head disposed in the interior of said body of said socket wrench, such that said file may be removed from said handle and socket wrench and said head may be inserted through said apertures and threaded into said first end of said handle to retain said file in position for use.

2. The combination tool device of claim 1, further comprising an aperture cover releasably interconnected to said body of said socket wrench over said first aperture so as to prevent said file from passing through said first aperture with said aperture cover in place over said first aperture.

3. The combination tool device of claim 1, wherein said body of said socket wrench is of greater cross-sectional dimension at said first end thereof than at said second end thereof.

4. The combination tool device of claim 3, wherein the configuration of said annular wall of said body of said socket wrench at said first and second ends of said body is hexagonal.

5. The combination tool device of claim 2, wherein said aperture cover is a thin plate extending over said first aperture and pivotally interconnected to said body of said socket wrench.

6. The combination tool device of claim 2, wherein said aperture cover is a resilient plug removably received in said first aperture.

7. A combination tool device, comprising a double-ended socket wrench, including an elongate hollow body having an annular wall, open first and second ends, and a longitudinal axis, said annular wall forming a hexagonal configuration at and inward of each of said first and second ends, said body including a first aperture penetrating said annular wall between said first and second ends of said body, and said body including a second aperture penetrating said annular wall in coaxial alignment with and in opposed relation to said first aperture across the longitudinal axis of said body;

an elongate handle having a longitudinal axis, an open first end, a closed second end, a hollow interior extending from said open first end through the majority of the length of said handle toward said second end, and an annular wall surrounding said hollow interior, said second end being beveled to form a standard screwdriver blade, the inner surface of said annular wall at said first end of said handle including screw threads extending from said surface into the interior of said handle, said handle being interconnected at said first end to said body of said socket wrench around said second aperture with the longitudinal axis of said handle in coaxial alignment with said first and second apertures and perpendicular to the longitudinal axis of said body of said socket wrench; and a file, including an elongate shaft with first and second ends and an outer cutting surface, and a head, of larger cross-sectional dimension than said shaft, disposed at said first end of said shaft, said head being threaded on the outer surface thereof and being configured and dimensioned such that said head may be threaded through said screw threads at said first end of said handle, with the length of said shaft being approximately equal to the length of the hollow interior of said handle and the cross-sectional dimension of said shaft being less than the cross-sectional dimension of said hollow interior of said handle, said file slidably received in the interior of said socket wrench and said handle with said head disposed in the hollow interior of said handle nearest said second end thereof with said shaft extending through the hollow interior of said handle and into the interior of said body of said socket wrench such that said file may be slid through said first aperture and outwardly from said socket wrench and said head may be threaded into said threads at said first end of said handle to retain said file.

8. The combination tool device of claim 7, further comprising an aperture cover releasably interconnected to said body of said socket wrench over said first aperture so as to prevent said file from passing through said first aperture with said aperture cover in place over said first aperture.

9. The combination tool device of claim 8, wherein said aperture cover is a thin plate extending over said first aperture and pivotally interconnected to said body of said socket wrench.

10. The combination tool device of claim 8, wherein said aperture cover is a resilient plug removably received in said first aperture.

11. The combination tool device of claim 7, wherein said body of said socket wrench is of greater cross-sectional dimension at said first end thereof than at said second end thereof.

12. A combination tool device, comprising a double-ended socket wrench, including an elongate hollow body having an annular wall, open first and second ends, and a longitudinal axis, said annular wall forming a hexagonal configuration at and inward of each of said first and second ends, said body including a first aperture penetrating said annular wall between said first and second ends of said body, a second aperture penetrating said annular wall in coaxial alignment with and in opposed relation to said first aperture across the longitudinal axis of said body, and an aperture cover removably covering said first aperture;

an elongate handle having a longitudinal axis, an open first end, a closed second end, a hollow interior extending from said open first end through the majority of the length of said handle toward said second end, and an annular wall surrounding said hollow interior, said second end being beveled to form a standard screwdriver blade, said handle including first retaining means at said first end of said handle for releasably retaining the head of a file, said handle being interconnected at said first end to said body of said socket wrench around said second aperture with the longitudinal axis of said handle in coaxial alignment with said first and second apertures and perpendicular to the longitudinal axis of said body of said socket wrench; and a file, including an elongate shaft with first and second ends and an outer cutting surface, and a head, of larger cross-sectional dimension than said shaft, disposed at said first end of said shaft, said head including second retaining means to releasably mate with said first retaining means of said handle, with the length of said shaft being approximately equal to the length of the hollow interior of said handle and the cross-sectional dimension of said shaft being less than the cross-sectional dimension of said hollow interior of said handle, said file slidably received in the interior of said socket wrench and said handle with said head disposed in the hollow interior of said handle nearest said second end thereof with said shaft extending through the hollow interior of said handle and into the interior of said body of said socket wrench such that said file may be slid through said first aperture and outwardly from said socket wrench and said second retaining means of said head mated with said first retaining means of said handle to releasably retain said file with the majority of the length of said shaft extending outwardly from said socket wrench.

13. The combination tool device of claim 12, wherein said first retaining means of said handle comprises screw threads extending from the inner surface of said annular wall and wherein said second retaining means comprises screw threads formed on said head of said file.

14. The combination tool device of claim 12, wherein said aperture cover is a thin plate extending over said first aperture and pivotally interconnected to said body of said socket wrench.

15. The combination tool device of claim 12, wherein said aperture cover is a resilient plug removably received in said first aperture.

16. The combination tool device of claim 12, wherein said body of said socket wrench is of greater cross-sectional dimension at said first end thereof than at said second end thereof.

17. The combination tool device of claim 12, wherein said handle is removably interconnected to said socket wrench.

18. The combination tool device of claim 12, wherein said handle is laterally divided between said first and second ends through said hollow interior thereof to form first and second portions, and wherein said first and second portions are releasably interconnected.

19. The combination tool device of claim 18, wherein said first and second portions are interconnected by mating screw threads.

* * * * *